US005133526A

United States Patent [19]

Olmsted

[11] Patent Number: 5,133,526

[45] Date of Patent: Jul. 28, 1992

[54] PICTURE HANGER

[76] Inventor: Robert G. Olmsted, 2 Barre St., Apt. 5, Montpelier, Vt. 05602

[21] Appl. No.: 503,512

[22] Filed: Mar. 30, 1990

[51] Int. Cl.[5] ..... A47G 1/00

[52] U.S. Cl. ..... 248/495; 40/152.1; 248/497

[58] Field of Search ..... 248/475, 495, 497, 498, 248/489, 909, 496; 40/152.1

[56] References Cited

U.S. PATENT DOCUMENTS

| | | | |
|---|---|---|---|
| 2,549,026 | 4/1951 | Skidmore | 248/497 |
| 4,890,353 | 1/1990 | Shannon et al. | 248/909 X |

FOREIGN PATENT DOCUMENTS

| | | | |
|---|---|---|---|
| 656559 | 1/1938 | Fed. Rep. of Germany | 248/498 |
| 712077 | 9/1931 | France | 248/498 |
| 160713 | 6/1933 | Switzerland | 248/497 |
| 102456 | of 1916 | United Kingdom | 248/498 |
| 104321 | 3/1917 | United Kingdom | 248/498 |
| 804316 | 11/1958 | United Kingdom | 248/497 |

*Primary Examiner*—David L. Talbott
*Attorney, Agent, or Firm*—Norman Friedland

[57] ABSTRACT

A picture frame or art form hanging means including the backing member of the frame being fabricated from a flat stiff material with a beaded edge formed about the aperture formed in the center of the backing members. Concentric beaded arcuate slots form another embodiment of the invention.

3 Claims, 2 Drawing Sheets

PICTURE HANGER

TECHNICAL FIELD

This invention relates to picture hangers and more particularly to simplified backing for the pictures permitting universal positioning of the picture.

BACKGROUND ART

There are sundry hanging mechanisms for pictures available in the marketplace and amongst those available are mechanisms that allow for either vertical and horizontal positioning of the picture Such hanging mechanisms, for example, are exemplified by U.S. Pat. No. 3,871,121 entitled PICTURE FRAME granted to O. B. Tornell on Mar. 18, 1975; U.S. Pat. No. 3,330,525 entitled PICTURE HANGING ASSEMBLY granted to L. Weinstein on Jul. 11, 1967. Each of these mechanisms have the commonality of attaching a member to the wall such as by a nail or the like which may accept a hook or the like to which is attached the picture. For instance, U.S. Pat. No. 3,330,525, supra shows a disk-like member having spiral slots or multi-holes that attach to the wall. The slots or holes are capable of accepting a hook to which is hung the picture.

U.S. Pat. No. 3,871,121, supra attaches a toroidally shaped member to the wall and this member cooperates with a complimentary shaped opening formed on the backing of the picture.

The present invention is intended to accomplish the same advantages outlined in the above referred to patents, but to do so in a more simplified and more economical manner. I have found that I can accommodate the hanging of pictures or other art forms by utilizing the backing of the picture or art form and retractably mounting the backing to a nail or hook supported in the wall where the picture or art form is to be displayed. It is contemplated within the scope of this invention that the backing may be outlined to accommodate different size frames.

DISCLOSURE OF INVENTION

An object of this invention is to provide an improved picture hanging mechanism that is characterized as simple to manufacture, install and is economical.

A feature of this invention is to provide a beaded aperture that may be circular directly on the backing of the picture frame that attaches to support means extending from the surface of the wall where the picture or art form is being displayed.

A still further feature of this invention is to provide a beaded aperture that is formed on the outer surface of the backing of a picture frame that allows for the universal positioning of the frame.

A still further feature of this invention is to outline with either peelable borders formed around the periphery of the backing that can be either peeled off or cut to size the backing to predetermined sized picture frames and the like.

A still further feature of this invention is to provide a plurality of concentric beaded apertures that allow for height adjustment of the picture frame while still permitting universal positioning of the picture frame.

Other objects, features and advantages of the present invention will become more apparent in the light of the following detailed description of exemplary embodiments thereof, as illustrated in the accompanying drawing.

BEST MODE FOR CARRYING TO THE INVENTION

While the preferred embodiments describe the beaded apertures to be circular in shape, one of ordinary skill in this art will appreciate that the apertures may be square, triangular and the like. Circular shape is preferred inasmuch as it permits the universal positioning of the picture or art form.

In the context of this disclosure, universal position refers to the 360° movement of the frame relative to the wall support mechanism.

Figure 2:
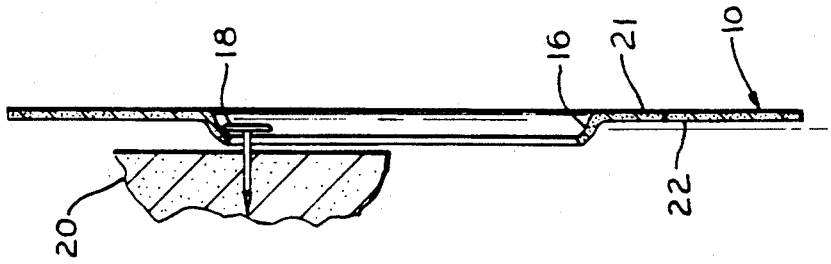
FIG. 2 is a sectional view taken along the lines 2—2 of FIG. 1 and also showing the attachment to a partially shown wall.
Figure 1:
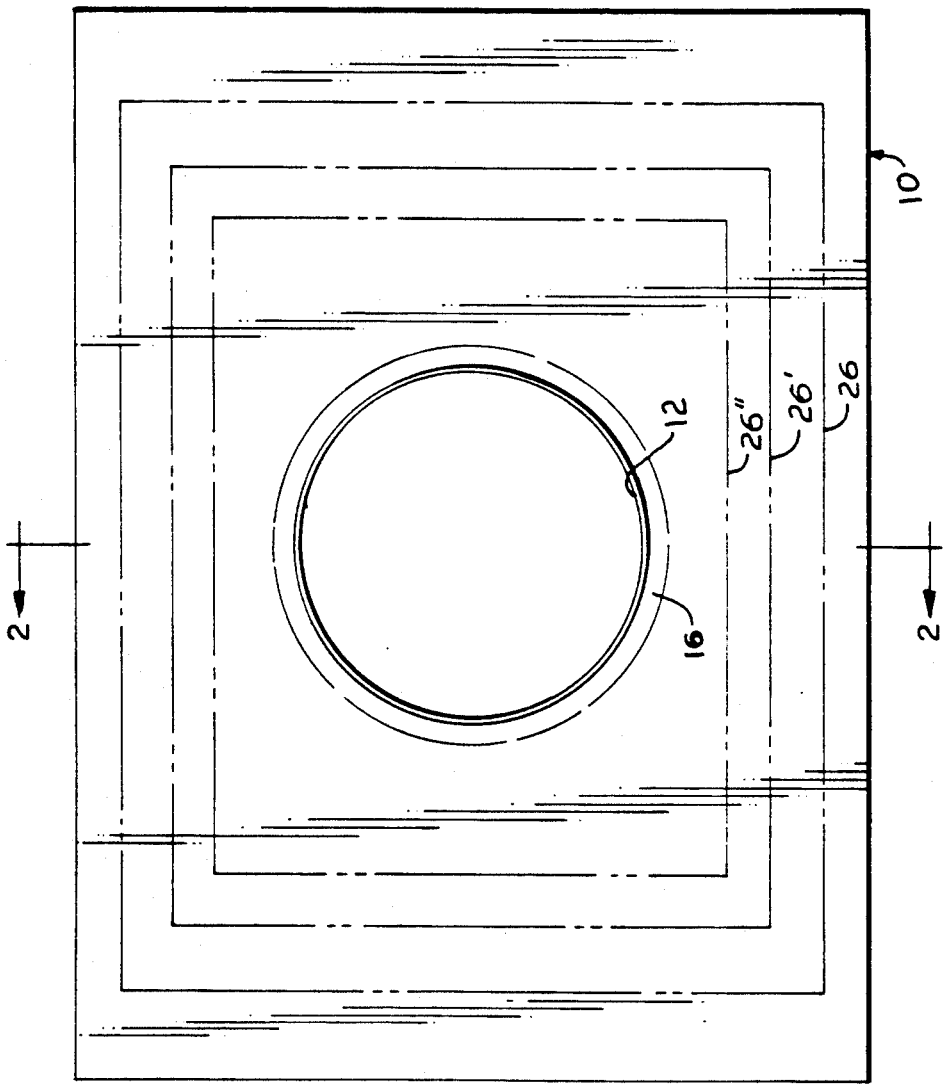
FIG. 1 is a plan view of the backing incorporating this invention.

Reference is now made to FIGS. 1 and 2 which discloses a backing member 10 fabricated from a flat stack which can be cardboard as other composition material that would be relatively stiff and capable of supporting the frame intended to be hung.

An aperture 12 is formed in the center of the backing member 10 and carries a beaded edge 16 extending beyond the surface 22 formed around the periphery of the aperture 12 by any suitable means such as rolling the material at the edge of the periphery. It may be necessary to insert a material in the beaded portion if additional support is found to be necessary. But for ordinary pictures, a preform bead will suffice.

As is apparent from the foregoing and noted particularly in FIG. 2, the backing may be readily attached to the head of a nail 18 which is inserted into the face of the wall 20 which will accommodate the picture frame or art form. While not shown, the backing will fit directly into the picture frame as by way of grooves formed on the edge of the frame or by other suitable attaching means (not shown). Obviously, the front surface 20 will accept the picture frame and the rear of surface 22 will be located in proximity to the surface of wall 20. It is also contemplated that any other suitable attaching means, like commercially available picture hanging hooks can be used in lieu of nail 18.

The peripheral edge of the backing 10 can be outlined or perforated to predetermined dimensions as for example shown as reference numeral 26, 26' and 26'' so as to be sized to accommodate different sized standard frames such as 8×10, 10×12, 7×9 and the like.

Figure 4:
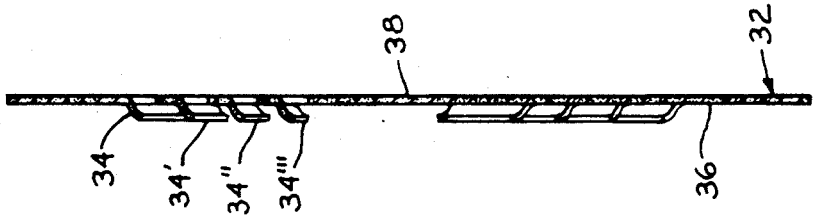
FIG. 4 is a sectional view taken along lines 4—4 of FIG. 3.
Figure 3:
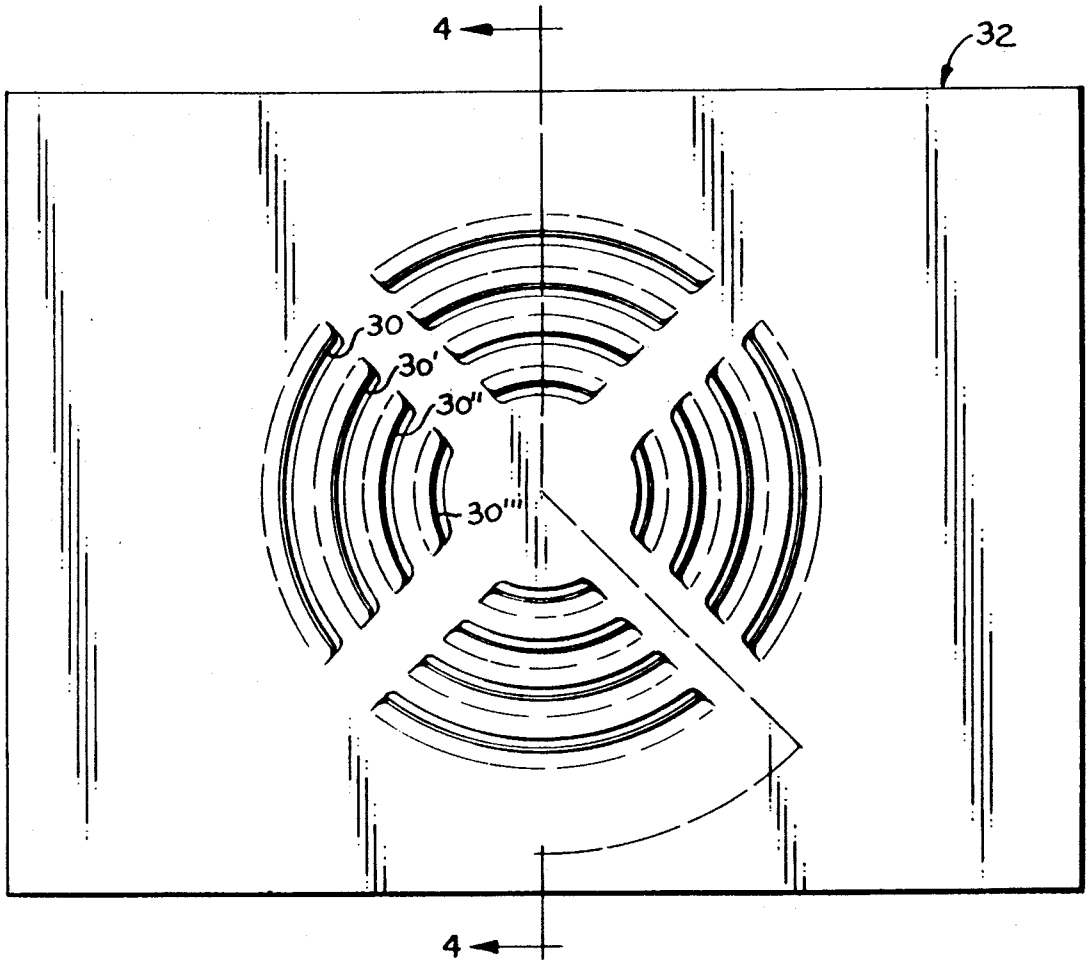
FIG. 3 is a plan view showing another embodiment of this invention.

FIGS. 3 and 4 exemplify another embodiment of this invention where concentric arcuate slots 30, 30', 30'' and 3''' are formed in the backing member 32 allowing for the frame utilizing the backing member 32 to be adjusted for different heights As noted in FIG. 4, each of the beaded edges 34, 34', 34'' and 34''' formed around the respective arcuate slots extend from the back surface 36 of backing member 32 and the front surface 38 accommodates the picture frame or other art form frame.

Obviously the number of arcuate slots as well as their shapes may vary depending on the particular application.

It will be appreciated from the foregoing that the invention affords a simple, yet inexpensive means for accommodating the hanging of picture frames and other art forms. Also, it provides simplified means for adjusting the picture or art form while the picture is already mounted on the wall or support used to hang the picture or art form.

Thus, although the invention has been shown and described with respect to exemplary embodiments thereof, it should be understood by those skilled in the art that the foregoing and various other changes, omissions and additions may be made therein and thereto without departing from the spirit and the scope of the invention.

I claim:

1. Means for attaching a picture or art object of the type that includes a frame comprising a backing member having a top edge, a bottom edge and parallel side edges defining a geometric square or rectangle adaptable to fit onto said frame and being substantially coextensive therewith, and having a back surface to be mounted adjacent a wall having a wall surface for accepting said frame, a central aperture in said backing, a beaded edge adjacent said aperture extending outwardly toward said wall surface, means supported in said wall and extending beyond said wall surface for being retractably inserted into said aperture whereby said frame is supported by said backing member and said frame is universally moveable relative to said means supported by said wall surface and having means for dimensioning said backing member including a plurality of parallelly spaced outlines being parallelly oriented with respect to said top edge, said bottom edge and said parallel side edges and being formed on said backing member so as to be indicative of a particular given size which is adaptable to fit a plurality of given sizes of frames.

2. Means as claimed in claim 1 wherein said aperture is circular.

3. Means as claimed in claim 1 wherein said means supported in said wall includes a nail having a head adapted to be supported by said bead.

* * * * *